US010851581B2

(12) United States Patent
Benes

(10) Patent No.: US 10,851,581 B2
(45) Date of Patent: Dec. 1, 2020

(54) METHOD AND SYSTEM FOR INSULATING STRUCTURAL BUILDING COMPONENTS

(71) Applicant: Oldcastle BuildingEnvelope, Inc., Plano, TX (US)

(72) Inventor: Philip M. Benes, Wausau, WI (US)

(73) Assignee: Oldcastle BuildingEnvelope, Inc., Plano, TX (US)

( * ) Notice: Subject to any disclaimer, the term of this patent is extended or adjusted under 35 U.S.C. 154(b) by 129 days.

(21) Appl. No.: 15/422,992

(22) Filed: Feb. 2, 2017

(65) Prior Publication Data

US 2017/0145733 A1 May 25, 2017

Related U.S. Application Data

(63) Continuation of application No. 13/802,146, filed on Mar. 13, 2013, now Pat. No. 9,574,831.
(Continued)

(51) Int. Cl.
*E06B 3/54* (2006.01)
*F28F 9/007* (2006.01)
(Continued)

(52) U.S. Cl.
CPC ..... *E06B 3/5481* (2013.01); *E06B 3/26* (2013.01); *E06B 3/26341* (2013.01); *E06B 3/325* (2013.01); *E06B 3/5409* (2013.01); *E06B 3/56* (2013.01); *E06B 3/64* (2013.01); *F28F 9/007* (2013.01); *Y10T 29/4935* (2015.01)

(58) Field of Classification Search
CPC . E06B 3/30; E06B 3/305; E06B 3/306; E06B 3/2735; E06B 3/273; E06B 3/26303; E06B 3/26305; E06B 3/2632; E06B 3/263; E06B 3/24; E06B 3/20; E06B 3/22; E06B 3/5481; E06B 3/5409; E06B 3/54;
(Continued)

(56) References Cited

U.S. PATENT DOCUMENTS 2,993,242 A * 7/1961 Leisibach ..... E06B 3/24 52/204.593
3,455,080 A 7/1969 Meadows
(Continued)

FOREIGN PATENT DOCUMENTS

CH 654897 A5 * 3/1986 ..... E06B 3/26301
DE 2855360 A1 * 7/1980 ..... E06B 3/26341
(Continued)

OTHER PUBLICATIONS

Copenheaver, Blaine R., "International Search Report" prepared for PCT/US2013/031075 dated May 21, 2013, 3 pages.

*Primary Examiner* — Tho V Duong
(74) *Attorney, Agent, or Firm* — Winstead PC

(57) ABSTRACT

In one aspect, the present invention relates to a structural assembly including a first frame member hingedly coupled to a second frame member. A support member extends outwardly from the first frame member. At least one glazing panel is disposed above the support member. A thermal clip is coupled to the support member. The thermal clip insulates the support member from a building exterior. The support member extends less than an entire length thereof and reduces loss of thermal energy from a building interior to the building exterior via the support member.

9 Claims, 6 Drawing Sheets

Related U.S. Application Data

(60) Provisional application No. 61/652,968, filed on May 30, 2012.

(51) Int. Cl.

| | |
|---|---|
| ***E06B 3/32*** | (2006.01) |
| ***E06B 3/263*** | (2006.01) |
| ***E06B 3/56*** | (2006.01) |
| ***E06B 3/26*** | (2006.01) |
| ***E06B 3/64*** | (2006.01) |

(58) Field of Classification Search
CPC ..... E06B 3/64; E06B 2003/26349; E06B 2003/2633; E06B 2003/2625; F28F 2280/105
See application file for complete search history.

(56) References Cited

U.S. PATENT DOCUMENTS

| | | | | | |
|---|---|---|---|---|---|
| 3,517,472 | A | | 6/1970 | Toth | |
| 4,304,081 | A | * | 12/1981 | Dawson | E06B 3/26341 49/DIG. 1 |
| 4,333,295 | A | | 6/1982 | Janke | |
| 4,495,726 | A | | 1/1985 | Lindstrom | |
| 4,614,062 | A | | 9/1986 | Sperr | |
| 4,625,479 | A | * | 12/1986 | Giguere | E06B 3/645 52/202 |
| 4,628,648 | A | * | 12/1986 | Winyard | E06B 3/26338 49/505 |
| 4,773,193 | A | | 9/1988 | Biebuyck et al. | |
| 4,873,803 | A | * | 10/1989 | Rundo | E06B 3/5418 52/202 |
| 5,379,518 | A | | 1/1995 | Hopper | |
| 5,617,695 | A | * | 4/1997 | Brimmer | E06B 3/26338 49/DIG. 1 |
| 6,035,596 | A | | 3/2000 | Brunnhofer | |
| 6,526,709 | B1 | * | 3/2003 | Jacobsen | E06B 1/02 52/202 |
| 2011/0011028 | A1 | * | 1/2011 | Rawlings | E06B 3/26303 52/656.5 |

FOREIGN PATENT DOCUMENTS

| | | | | | |
|---|---|---|---|---|---|
| DE | 3017912 | A1 | * | 11/1980 | E06B 1/325 |
| FR | 2746843 | A1 | | 10/1997 | |
| FR | 2919889 | A1 | | 2/2009 | |
| GB | 2013267 | A | * | 8/1979 | E06B 3/26301 |

* cited by examiner

METHOD AND SYSTEM FOR INSULATING STRUCTURAL BUILDING COMPONENTS

CROSS-REFERENCE TO RELATED APPLICATIONS

This application is a continuation of U.S. patent application Ser. No. 13/802,146, filed on Mar. 13, 2013. U.S. patent application Ser. No. 13/802,146 claims priority from U.S. Provisional Patent Application No. 61/652,968, filed May 30, 2012. U.S. patent application Ser. No. 13/802,146 and U.S. Provisional Patent Application No. 61/652,968 are each incorporated herein by reference.

BACKGROUND

Field of the Invention

The present application relates generally to structural building components and more particularly, but not by way of limitation, to methods and systems for thermal insulation of structural building members to reduce heat transfer.

History of the Related Art

The trend of increasing prices for natural gas, electricity, and other heating fuels have made energy efficiency a high-profile issue. In buildings, thermal energy may be lost to the atmosphere through, for example, radiation, convection, or conduction. Radiation is the transfer of thermal energy through electromagnetic waves. Convection takes place as a result of molecular movement, known as currents or convective looping, within fluids. A common mode of convection occurs as a result of an inverse relationship between a fluid's density and temperature. Typically, such type of convection is also referred to as "natural" or "free" convection where heating of a fluid results in a decrease in the fluid's density. Denser portions of the fluid fall while less dense portions of the fluid rise thereby resulting in bulk fluid movement. A common example of natural convection is a pot of boiling water in which hot (and less dense) water at a bottom of the pot rises in plumes and cooler (more dense) water near the top of the pot sinks. The primary means of thermal energy loss across an un-insulated air-filled space is natural convection.

Conduction is the transfer of thermal energy between regions of matter due to a temperature gradient. Heat is transferred by conduction when adjacent atoms vibrate against one another. Conduction is the most significant form of heat transfer within a solid or between solid objects in thermal contact. Conduction is more pronounced in solids due to a network of relatively fixed spatial relationships between atoms. Thus, conductivity tends to vary with density. Metals such as, for example, copper and aluminum, are typically the best conductors of thermal energy.

Thermal efficiency of building components are often expressed in terms of thermal resistance ("R-value") and thermal transmission ("U-factor"). R-value is a measurement of thermal conductivity and measures a product's resistance to heat loss. In common usage, R-value is used to rate building materials such as, for example, insulation, walls, ceilings, and roofs that generally do not transfer significant amounts of heat by convection or radiation. A product with a higher R-value is considered more energy efficient.

Of particular concern in buildings are windows and doors. In particular, windows come in contact with the environment in ways that walls and solid insulation do not. As a result, windows are strongly affected by convection as well as radiation. For this reason, U-factor is commonly used as a measure of energy efficiency of windows. For example, U-factor measures a rate of total heat transfer through a product such as, for example, a window or a door (including heat transfer by convection and radiation). A product with a lower U-factor is considered more energy efficient. In recent years, federal, state, and municipal building codes often specify minimum R-values and maximum U-factors for building components.

SUMMARY

The present application relates generally to structural building components and more particularly, but not by way of limitation, to methods and systems for thermal insulation of structural building members to reduce heat transfer. In one aspect, the present invention relates to a structural assembly including a first frame member hingedly coupled to a second frame member. A support member extends outwardly from the first frame member. At least one glazing panel is disposed above the support member. A thermal clip is coupled to the support member. The thermal clip insulates the support member from a building exterior. The support member extends less than an entire length thereof and reduces loss of thermal energy from a building interior to the building exterior via the support member.

In another aspect, the present invention relates to a method for improving thermal performance of a structural assembly. The method includes forming a first frame member and coupling the first frame member to a second frame member. The method further includes forming a support member extending outwardly from the first frame member and disposing at least one glazing panel above the support member such that the support member extends less than an entire length thereof. The method further includes coupling the support member to a thermal clip. The thermal clip reduces loss of thermal energy to a building exterior via the support member.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
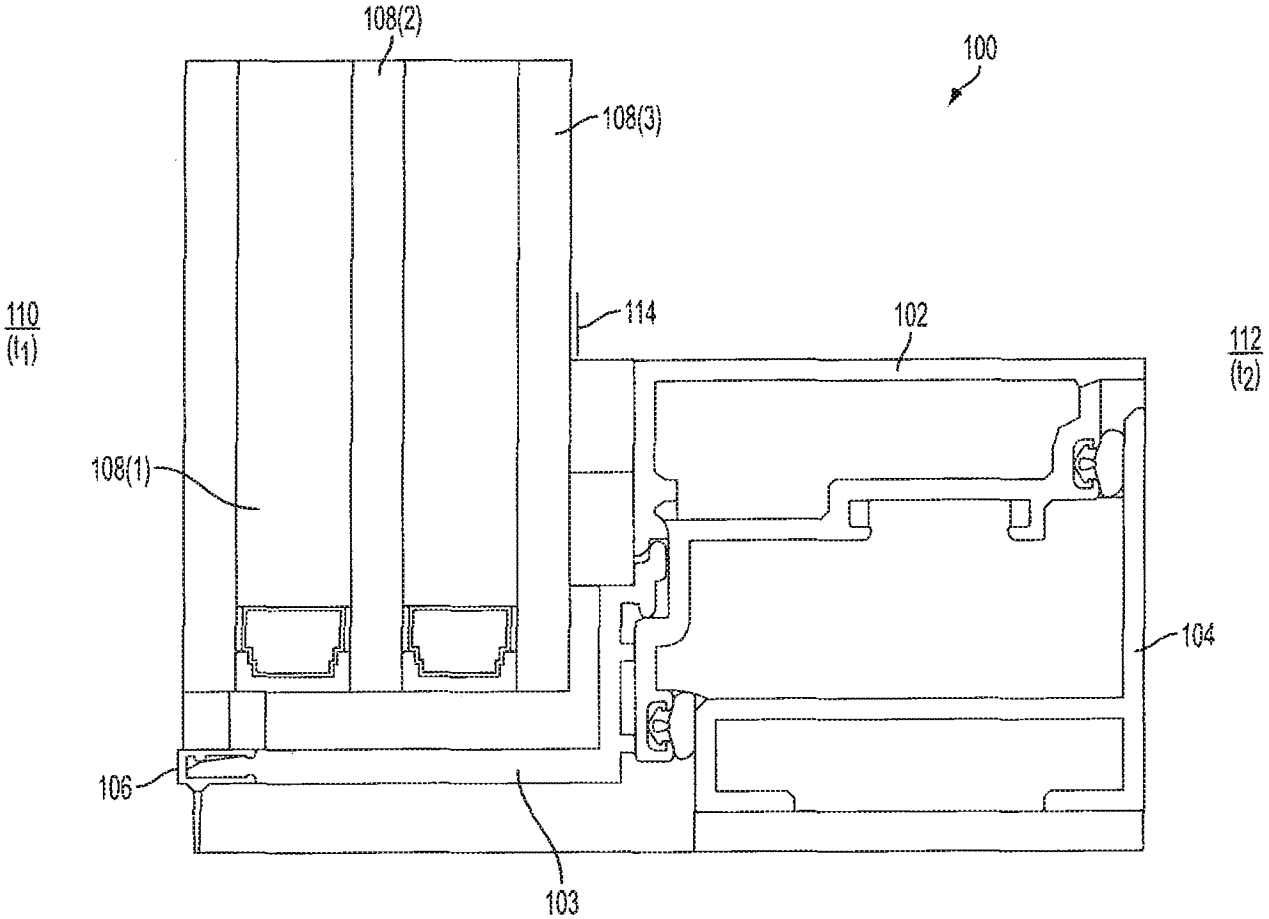
FIG. 1 PRIOR ART
FIG. 1 is a cross-sectional view of a prior-art structural assembly.

FIG. 1 is cross-sectional view of a prior-art structural assembly 100. The structural assembly 100 includes a first frame member 102 coupled to a second frame member 104. The first frame member 102 is typically hingedly coupled to the second frame member 104; however, other forms of connection may be utilized depending on design requirements. A support member 103 extends outwardly from the first frame member 102. A plurality of glazing panels 108(1)-(3) are disposed above the support member 103. An insulator 106 is attached to an end of the support member 103. In a typical embodiment, the insulator 106 is constructed at least in part of a non-thermally-conductive material. As shown in FIG. 1, the support member 103 extends substantially entirely underneath the plurality of glazing panels 108(1)-(3).

During operation, the structural assembly 100 is disposed between a building exterior 110, at a first temperature ($t_1$), and a building interior 112, at a second temperature ($t_2$). In applications where the first temperature ($t_1$) is substantially lower than the second temperature ($t_2$), such as for, example, 70 degrees Fahrenheit or more, thermal energy is conducted from warmer portions of the structural assembly 100 near the building interior 112 to cooler portions of the structural assembly 100 near the building exterior 110. Such conduction results in loss of thermal energy to the building exterior via the support member 103. By way of example, a temperature of the structural assembly 100 at point 114 is shown to be 41.7 degrees Fahrenheit.

Figure 2:
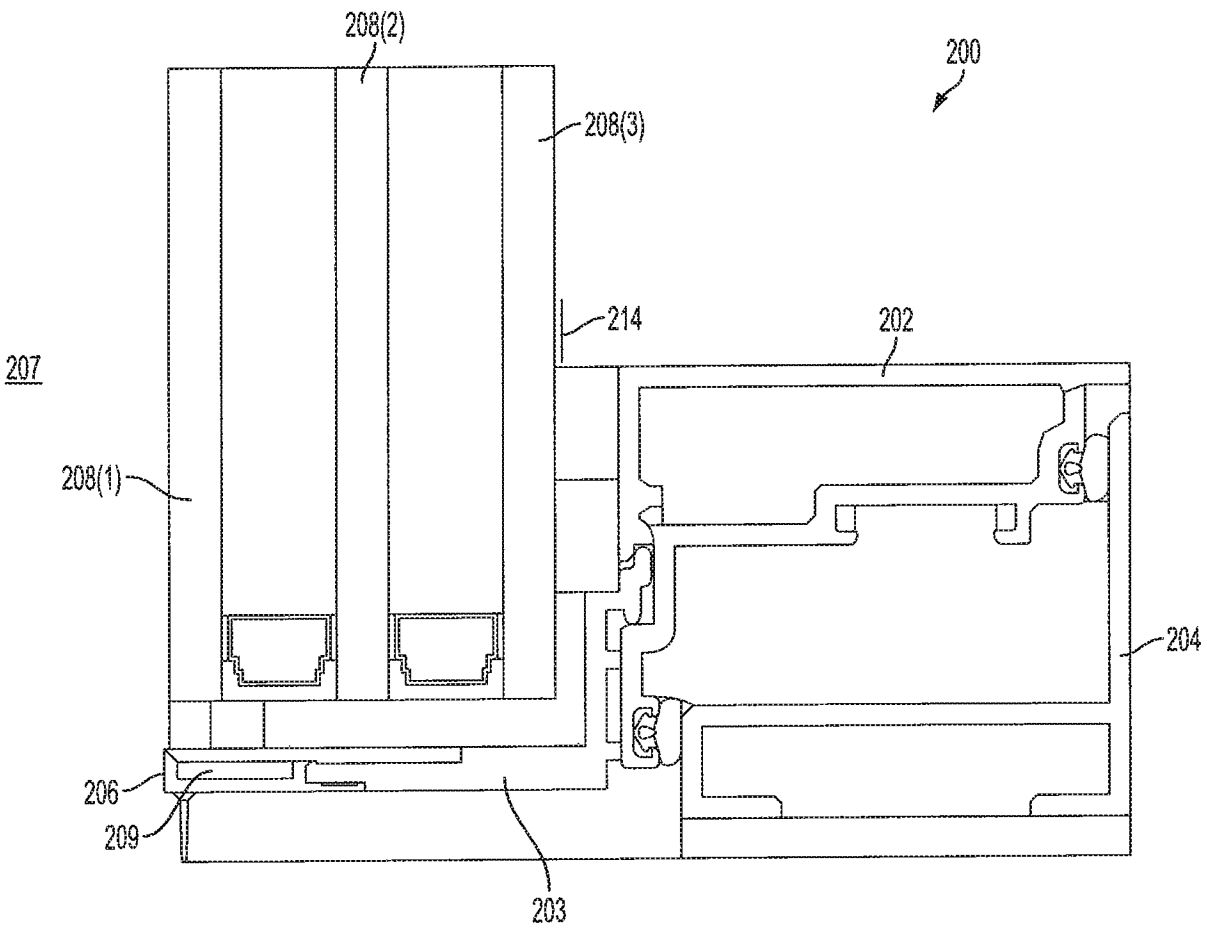
FIG. 2 is a cross-sectional view of a structural assembly according to an exemplary embodiment.

FIG. 2 is a cross-sectional view of a structural assembly 200 according to an exemplary embodiment. The structural assembly 200 includes a first frame member 202 coupled to a second frame member 204. In a typical embodiment, the first frame member 202 is hingedly coupled to the second frame member 204; however, in other embodiments, other forms of connection may be utilized depending on design requirements. A support member 203 extends outwardly from the first frame member 202. In the embodiment shown in FIG. 2, the first frame member 202 and the support member 203 are separate elements; however, in other embodiments, structural assemblies utilizing principles of the invention may include a support member and a first frame member that are unitary. A plurality of glazing panels 208(1)-(3) are disposed above the support member 203. As shown in FIG. 2, the support member 203 extends less than an entire length underneath the plurality of glazing panels 208(1)-(3). In a typical embodiment, the plurality of glazing panels 208(1)-(3) are, for example, structural glass, however, in other embodiments, the plurality of glazing panels 208(1)-(3) may be granite, slate, or other material as dictated by design requirements. A thermal clip 206 is coupled to an end of the support member 203. In a typical embodiment, the thermal clip 206 is constructed from a non-thermally-conductive material such as, for example, plastic, rubber, fiberglass, or other appropriate material as dictated by design requirements. The thermal clip at 206 has an air gap 209 formed therein. The air gap 209 insulates the support member 203 from a building exterior 207 and reduces loss of thermal energy to the building exterior 207 via the support member 203. In contrast to FIG. 1, the temperature of the structural assembly 200 at point 214 is shown by way of example to be 49.4 degrees Fahrenheit. Thus, use of the thermal clip 206 improves thermal performance of the structural assembly 200.

Figure 3B:
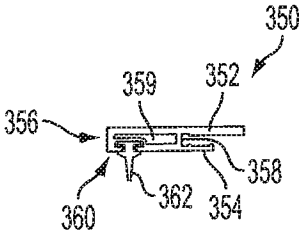
FIGS. 3A-3D are cross-sectional views of various embodiments of a thermal clip.
Figure 3D:
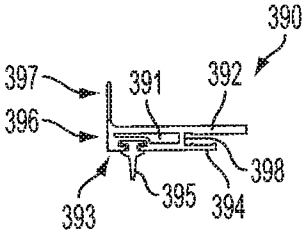
Figure 3A:
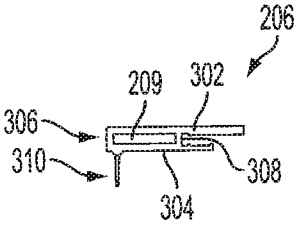

FIG. 3A is a cross-sectional view of the thermal clip 206 according to an exemplary embodiment. The thermal clip 206 includes a top member 302, a bottom member 304, an outer cross member 306, and an inner cross member 308. The air gap 209 is defined by the top member 302, the bottom member 304, the outer cross member 306, and the inner cross member 308. The air gap 209 insulates the support member 203 from a building exterior 207 and reduces loss of thermal energy to the building exterior 207 via the support member 203. Weather stripping 310 is disposed below the thermal clip 206 and operatively coupled to the bottom member 304. In a typical embodiment, the weather stripping 310 is constructed from, for example, a flexible material such as, for example, soft plastic. In a typical embodiment, the weather stripping 310 is co-extruded with the thermal clip 206 and prevents infiltration of fluid such as, for example, water into an area underneath the support member 203 (shown in FIG. 2). In other embodiments, the thermal clip 206 is solid and the air gap 209 is omitted.

FIG. 3B is a cross-sectional view of a thermal clip 350 according to an exemplary embodiment. The thermal clip 350 includes a top member 352, a bottom member 354, an outer cross member 356, and an inner cross member 358. An air gap 359 is defined by the top member 352, the bottom member 354, the outer cross member 356, and the inner cross member 358. The air gap 359 insulates the support member 203 from a building exterior 207 and reduces loss of thermal energy to the building exterior 207 via the support member 203. A slot 360 is formed in the bottom member 354. Weather stripping 362 is inserted into the slot 360. In a typical embodiment, the weather stripping 362 prevents infiltration of fluid such as, for example, water into an area underneath the support member 203 (shown in FIG. 2). In other embodiments, the thermal clip 350 is solid and the air gap 359 is omitted.

Figure 3C:
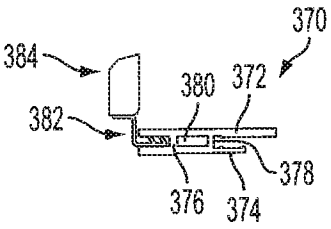

FIG. 3C is a cross-sectional view of a thermal clip 370 according to an exemplary embodiment. The thermal clip 370 includes a top member 372, a bottom member 374, an outer cross member 376, and an inner cross member 378. An air gap 380 is defined by the top member 372, the bottom member 374, the outer cross member 376, and the inner cross member 378. The air gap 380 insulates the support member 203 from a building exterior 207 and reduces loss of thermal energy to the building exterior 207 via the support member 203. In other embodiments, the thermal clip 370 is solid and the air gap 380 is omitted. A receptor 382 is formed in an end of the thermal clip 370 and is defined by the top member 372 and the bottom member 374. An edge protector 384 is inserted into the receptor 382. The edge protector 384 extends generally perpendicular upwardly from the top member 372. In a typical embodiment, the edge protector 384 protects the plurality of glazing panels 208(1)-(3) (shown in FIG. 2) disposed above the thermal clip 370. In various embodiments, the edge protector 384 also functions as a gasket seal between the first frame member 202 and the second frame member 204 when the first frame member is in the closed position.

FIG. 3D is a cross-sectional view of a thermal clip 390 according to an exemplary embodiment. The thermal clip 390 includes a top member 392, a bottom member 394, an outer cross member 396, and an inner cross member 398. An air gap 391 is defined by the top member 392, the bottom member 394, the outer cross member 396, and the inner cross member 398. The air gap 391 insulates the support member 203 from a building exterior 207 and reduces loss of thermal energy to the building exterior 207 via the support member 203. In other embodiments, the thermal clip 390 is solid and the air gap 391 is omitted. A slot 393 is formed in the bottom member 394. Weather stripping 395 is inserted into the slot 393. In a typical embodiment, the weather stripping 395 prevents infiltration of fluid such as, for example, water into an area underneath the support member 203 (shown in FIG. 2). An edge protector 397 extends upwardly from the top member 392 in a generally perpendicular fashion. In a typical embodiment, the edge protector 397 is constructed from, for example, a soft plastic. In a typical embodiment, the edge protector 397 is co-extruded with the thermal clip 390. In other embodiments, structural assemblies utilizing principles of the invention may include thermal clips having any combination of the features described in FIGS. 3A-3D.

Figure 4:
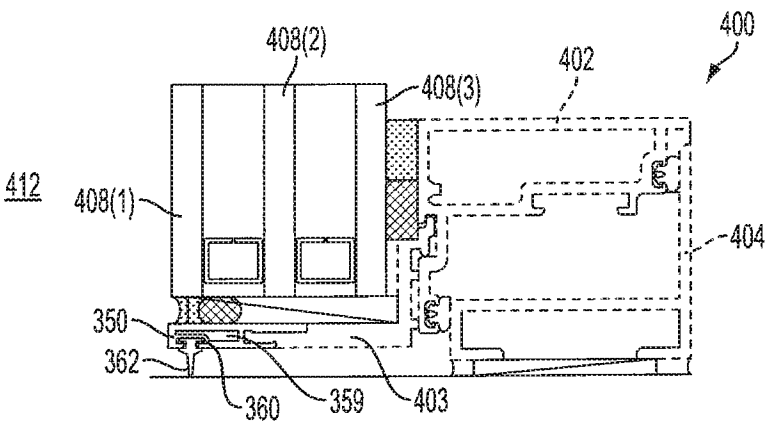
FIG. 4 is a cross-sectional view of a structural assembly illustrating use of the thermal clip of FIG. 3B in a triple-glazed application according to an exemplary embodiment.

FIG. 4 is a cross-sectional view of a structural assembly 400 illustrating the thermal clip 350 according to an exemplary embodiment. The structural assembly 400 is similar to the structural assembly 200 discussed above in FIG. 2. The structural assembly 400 includes a first frame member 402 coupled to a second frame member 404. In a typical embodiment, the first frame member 402 is hingedly coupled to the second frame member 404; however, in other embodiments, other forms of connection may be utilized depending on design requirements. A support member 403 extends outwardly from the first frame member 402. In the embodiment shown in FIG. 4, the first frame member 402 and the support member 403 are separate elements; however, in other embodiments, structural assemblies utilizing principles of the invention may include a support member and a first frame member that are unitary. A plurality of glazing panels 408(1)-(3) are disposed above the support member 403. As shown in FIG. 4, the support member 403 extends less than an entire length under the plurality of glazing panels 408 (1)-(3). The embodiment shown in FIG. 4 illustrates three glazing panels 408(1)-(3); however, in other embodiments structural assemblies utilizing principles of the invention may include a different number of glazing panels. The thermal clip 350 is coupled to an end of the support member 403. In a typical embodiment, the thermal clip 350 is constructed, at least in part, of a non-thermally-conductive material. The weather stripping 362 is inserted into the slot 360 formed on the bottom member 354 of the thermal clip 350. In a typical embodiment, the weather stripping 362 prevents infiltration of fluid under the support member 403. The air gap 359 present in the thermal clip 350 insulates the support member 403 from a building exterior 412 and reduces loss of thermal energy to the building exterior 412 via the support member 403.

Figure 5B:
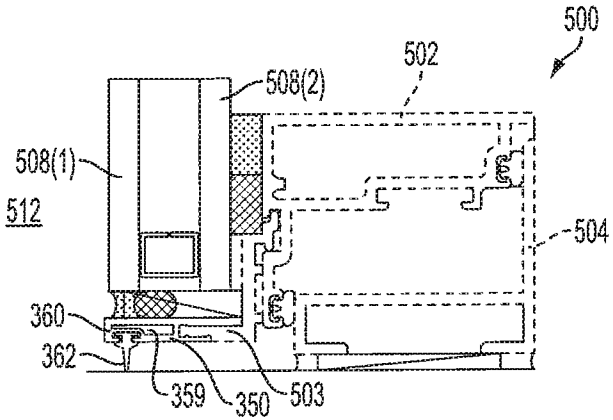
FIG. 5B is a cross-sectional view of the structural assembly of FIG. 5A according to an exemplary embodiment.
Figure 5A:
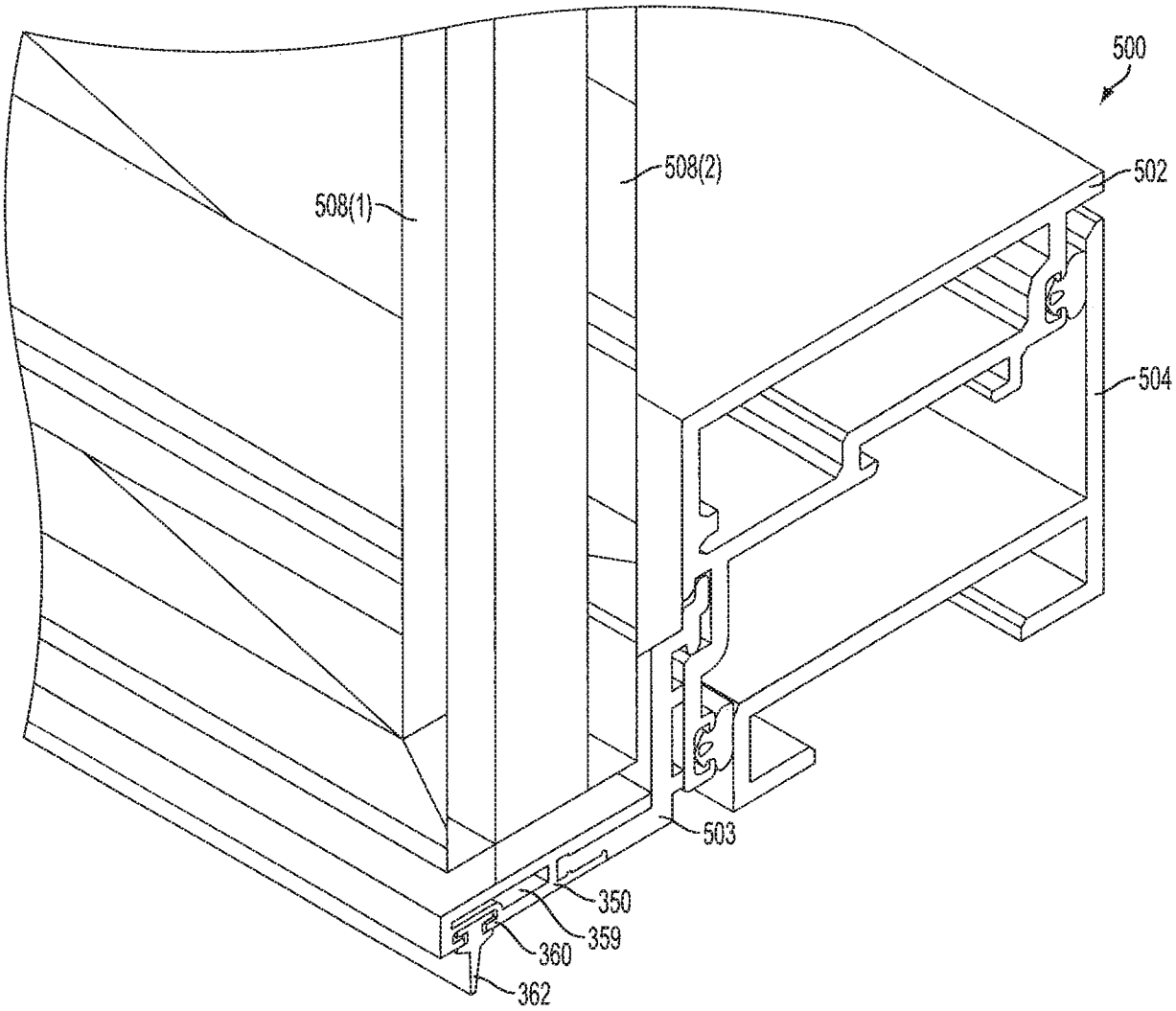
FIG. 5A is an isometric view of a structural assembly illustrating use of the thermal clip of FIG. 3B in a double-glazed application according to an exemplary embodiment.

FIG. 5A is an isometric view of a structural assembly 500 illustrating use of the thermal clip 350 in a double-glazed application. FIG. 5B is a cross-sectional view of the structural assembly of FIG. 5A. The structural assembly 500 includes a first frame member 502 coupled to a second frame member 504. In a typical embodiment, the first frame member 502 is hingedly coupled to the second frame member 504; however, in other embodiments, other forms of connection may be utilized depending on design requirements. A support member 503 extends outwardly from the first frame member 502. In the embodiment shown in FIG. 5, the first frame member 502 and the support member 503 are separate elements; however, in other embodiments, structural assemblies utilizing principles of the invention may include a support member and a first frame member that are unitary. A plurality of glazing panels 508(1)-(2) are disposed above the support member 503. As shown in FIG. 5, the support member 503 extends less than an entire length under the plurality of glazing panels 508(1)-(2). The embodiment shown in FIG. 5 illustrates two glazing panels 508(1)-(2); however, in other embodiments structural assemblies utilizing principles of the invention may include a different number of glazing panels. The thermal clip 350 is coupled to an end of the support member 503. The weather stripping 362 is inserted into the slot 360 formed on the bottom member 354 of the thermal clip 350. In a typical embodiment, the weather stripping 362 prevents infiltration of fluid under the support member 503. The air gap 359 insulates the support member 503 from a building exterior 512 and reduces loss of thermal energy to the building exterior 512 via the support member 503.

Figure 6:
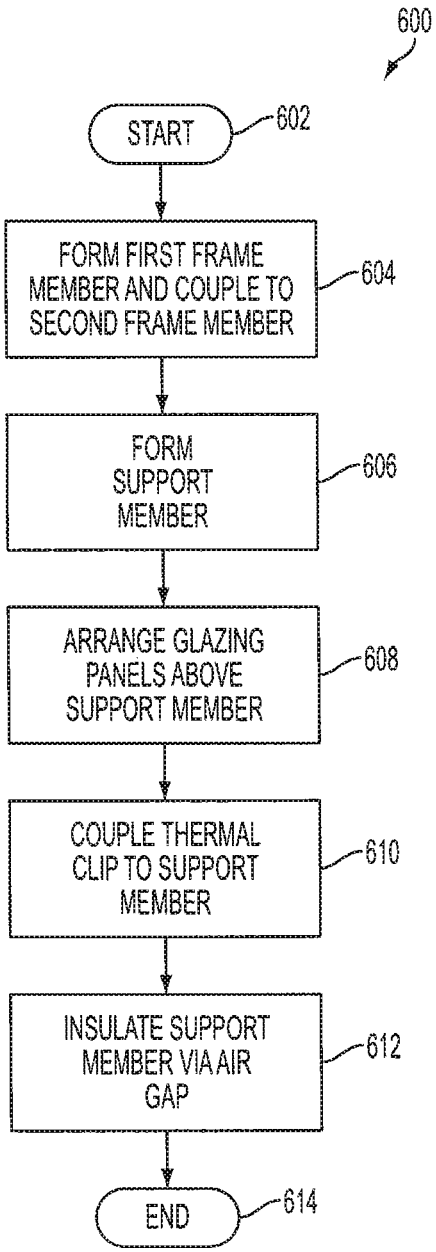
FIG. 6 is a flow diagram illustrating a process for improving thermal performance of the structural assembly of FIG. 2 according to an exemplary embodiment.

FIG. 6 is a flow diagram illustrating a process for improving thermal performance of a structural assembly. A process 600 begins a step 602. At step 604 a first frame member 202 is formed and coupled to a second frame member 204. At step 606 a support member 203 is formed that extends outwardly from the first frame member 202. At step 608, a plurality of glazing panels 208(1)-(3) are disposed above the support member 203. At step 610, the support member 203 is coupled to a thermal clip 206. The thermal clip 206 has an air gap 209 formed therein. Although step 608 is described herein as preceding step 610, in other embodiments, step 610 may precede step 608 depending on design requirements. At step 612, the air gap 209 present in the thermal clip 206 insulates the support member from the building exterior 207 and reduces loss of thermal energy to the building exterior 207 via the support member 203. The process 600 ends at step 614. Although FIG. 6 is described with reference to the structural assembly 200, one skilled in the art will recognize that the process 600 described in FIG. 6 could be utilized with the structural assembly 400, the structural assembly 500, or any other embodiment not specifically illustrated herein. Furthermore, while FIG. 6 is described with reference to the thermal clip 206, one skilled in the art will recognize that the process 600 illustrated in FIG. 6 could utilize the thermal clip 350, the thermal clip 370, and the thermal clip 390.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A method for improving thermal performance of a structural assembly, the method comprising:

forming a first frame member, the first frame member comprising a first horizontal member;

hingedly coupling the first frame member to a second frame member;

forming a support member, the support member comprising a second horizontal member that extends outwardly from the first horizontal member at a level below the first horizontal member;

disposing at least one glazing panel above the support member such that the support member extends less than an entire length of the glazing panel; and coupling the support member to a thermal clip, which extends outwardly from the support member and insulates the support member from a building exterior by way of an air gap formed between a distal-most vertical boundary of the support member and a vertical exterior member of the thermal clip, wherein the thermal clip reduces loss of thermal energy to a building exterior via the support member.

2. The method of claim 1, wherein the air gap isolates the support member from the building exterior.

3. The method of claim 1, comprising inserting a weather strip into a slot formed on the thermal clip.

4. The method of claim 1, comprising co-extruding a weather strip with the thermal clip.

5. The method of claim 1, comprising inserting an edge protector into a slot formed on the thermal clip.

6. The method of claim 1, comprising co-extruding an edge protector with the thermal clip.

7. The method of claim 1, comprising coupling an edge protector to the thermal clip.

8. The method of claim 1, wherein the thermal clip is constructed of a thermally non-conductive material.

9. The method of claim 1, wherein the thermal clip comprises an intermediate member disposed between the distal-most vertical boundary of the support member and the vertical exterior member of the thermal clip.

* * * * *